United States Patent [19]

Longacre et al.

[11] 4,344,651

[45] Aug. 17, 1982

[54] CORROSIVE ENVIRONMENT TENSION PACKER

[75] Inventors: Kenneth E. Longacre; Marvin R. Kruschke, Sr., both of Farmington, N. Mex.

[73] Assignee: Baker International Corporation, Orange, Calif.

[21] Appl. No.: 167,300

[22] Filed: Jul. 10, 1980

[51] Int. Cl.[3] ..... E21B 23/03; E21B 23/06; E21B 33/138; E21B 43/28

[52] U.S. Cl. ..... 299/5; 166/387; 166/196

[58] Field of Search ..... 299/5, 4; 166/196, 138, 166/118, 315, 387, 381

[56] References Cited

U.S. PATENT DOCUMENTS

| | | | |
|---|---|---|---|
| 2,429,910 | 10/1947 | Anderson et al. | 166/140 |
| 2,568,867 | 9/1951 | Otis | 166/214 |
| 2,695,067 | 11/1954 | Smith et al. | 166/240 X |
| 2,715,943 | 8/1955 | True | 166/118 X |
| 2,729,293 | 1/1956 | Cloud | 166/118 |
| 2,884,071 | 4/1959 | Fredd | 166/140 X |
| 3,556,597 | 1/1971 | Porter | 299/5 |
| 4,239,288 | 12/1980 | Thompson et al. | 299/5 |

*Primary Examiner*—Stephen J. Novosad
*Attorney, Agent, or Firm*—William C. Norvell, Jr.

[57] ABSTRACT

A packer assembly and its method of use are provided, the packer assembly being carried on a first conduit for use in wells exposed to corrosive injection fluids, the well being encased by a second conduit having a locking recess defined therein, such as by having first and second conduit members, the conduit members being interengaged by coupling whereby the locking recess is defined by the coupling element and between the conduit members. The assembly comprises a body member communicating to the first conduit and having a slotted configuration thereon. An inwardly flexible, outwardly urged collet assembly is exterior of the body, with control means on the collet assembly being carryable within the slotted configuration. Means on said body define a pocket for selective receipt of the collet assembly for locking the collet assembly relative to the locking recess. An elastomeric packer body means below the pocket means and carried by the body member is contourably urged into sealing relation with the second conduit subsequent to locking engagement of the collet assembly and the second conduit.

5 Claims, 10 Drawing Figures

CORROSIVE ENVIRONMENT TENSION PACKER

BACKGROUND OF THE INVENTION

1. Field of the Invention

The invention relates to a packer apparatus which is adapted for use in corrosive environments within subterranean wells.

2. Description of the Prior Art

In-situ mining and in-situ leaching are synonymous processes employed to extract minerals from the earth without the removal of the ore body. These processes involve injection of a suitable fluid into the ore deposit in order to dissolve the valuable mineral, and lifting the mineral-laden fluid to the surface for extraction. Although somewhat similar to water flooding operations, in-situ mining is distinctly different from water flooding because of the exposure to and use of highly corrosive fluids, often called lixiviants, such as sulfuric acid solutions. These solutions are injected into an injection well for removal of an ore deposit, such as copper or uranium, from within one of several production wells, which may encircle the injection well. The corrosive fluids are chosen to dissolve portions of the ore body. Any lixiviant capable of reacting with and dissolving copper, unranium or other minerals usually will be very corrosive to conventional oil field equipment.

Because of the corrosive environment of such wells, the casing string must be made of a material which is resistant to the adverse effects of highly corrosive materials, such as sulfuric acid solutions. Typical of such materials is casing made of a fiberglass reinforced epoxy resin. However, because of the malleable nature of such casing, conventional packers, utilizing slip assemblies having teeth members protruding thereon for grasping around the internal diameter of the casing, are undesirable for such purposes.

The present invention provides a packer assembly which may be anchored in such a well without the use of slips, by utilization of a collet mechanism which is received within a recess defined on the casing string for anchoring engagement of the packer assembly. The metallic components of the packer assembly preferably may be made of stainless steel, or other non-corrosive material.

SUMMARY OF THE INVENTION

A packer assembly and its method of use are provided, the packer assembly being carried on a first conduit for use in a well exposed to corrosive fluids, the well being encased by second conduit typically having first and second conduit members, the conduit members being interengaged by coupling whereby a locking recess is defined within the coupling element and between the conduit members. The locking recess can also be defined on the second conduit by other known, conventional means. The assembly comprises a body member communicating to the first conduit and having a slotted configuration thereon. An inwardly flexible, outwardly urged collet assembly is exterior of the body, with control means on the collet assembly being carryable within the slotted configuration. Means on said body define a pocket for selective receipt of the collet assembly for locking the collet assembly relative to the locking recess. An elastomeric packer body means below the pocket means and carried by the body member is contourably urged into sealing relation with the second conduit subsequent to locking engagement of the collet assembly and the second conduit.

DESCRIPTION OF THE PREFERRED EMBODIMENTS

Figure 1:
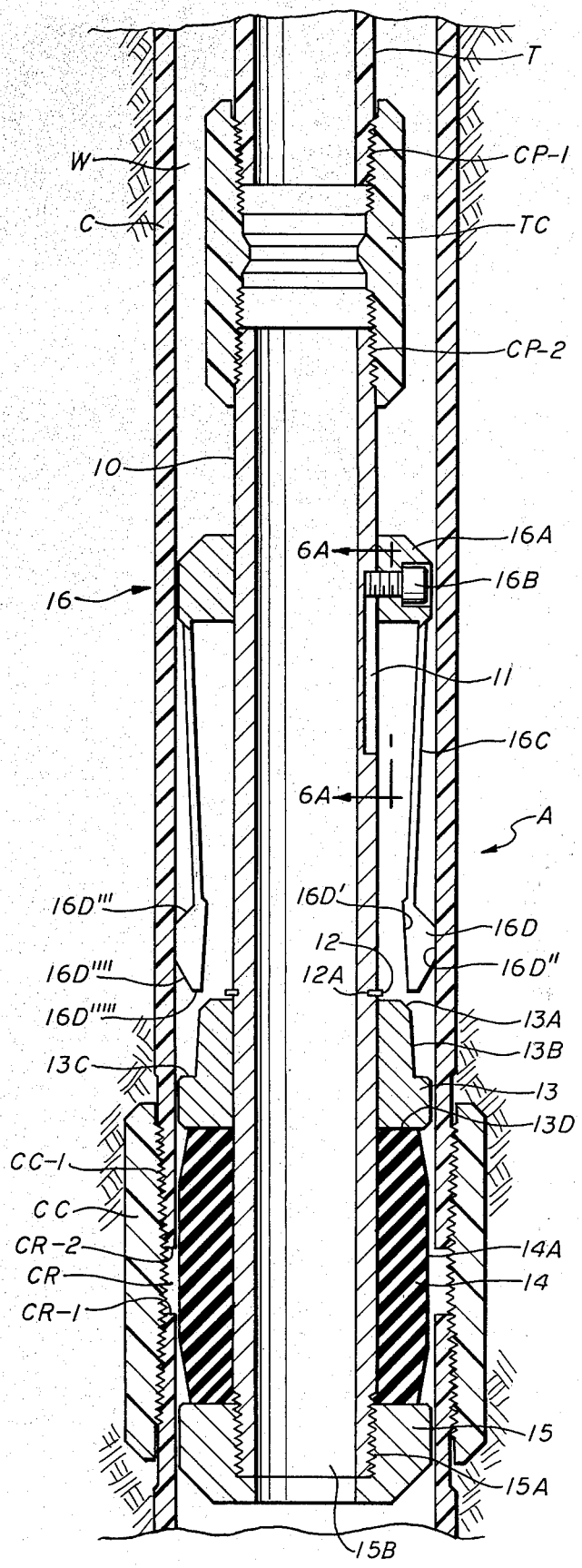
FIG. 1 is a longitudinal sectional view of the apparatus of the present invention being run into the well.

Referring now to FIG. 1, the apparatus A is shown as being carried on the lowermost end of a section of tubing T which is inserted within a well bore W having a fiberglass reinforced epoxy resin casing C with perforations P shot through the casing C at an injection zone Z1. (shown in FIG. 2)

A casing coupling CC has threads CC-1 at its uppermost end for affixation to the lowermost end of the tubing string T, with the threads CC-1 at the lowermost end of the tubing coupling CC being engaged to companion threads on the elongated body 10 of the apparatus A. The body 10 has defined on one side of its exterior a configured slot arrangement 11, shown in more detail in FIGS. 6A through 6E, the slot 11 receiving an interiorly protruding end of a control pin 16B carried on a collet assembly 16 which is defined around the exterior of the body 10. Somewhat below the slot 11 on the body 10 is a circumferentially extending outwardly protruding retainer ring 12 housed within a companion grooveway 12A on the body 10, for preventing upward longitudinal travel of an enlarged cone member 13 carried below the retainer ring 12 on the body 10, functional in anchoring the apparatus A relative to the casing C and for setting of the packer element 14.

An outwardly facing, lowerly extending upper bevel 13A is contoured on the cone 13 for initial receipt and guidance of the lowermost end of the collet assembly 16 subsequent to locating a recess CR in the coupling CC during the anchoring procedure. An outer wall 13B and a upwardly facing shoulder 13C together provide a pocket for encirclement of the collet assembly 16 within the casing coupling recess CR for anchoring engagement of the apparatus A relative to the casing C. The lower end 13D of the cone 13 is shouldered against the uppermost end of an elastomeric packer element 14 carried exteriorly therebelow around the body 10. The outer smooth surface 14A of the packer element 14 will become sealingly engaged upon the inner wall of the casing C, when the apparatus is manipulated to "packed off" position, shown in FIG. 5.

The lowermost end of the apparatus A is defined by a guide 15 having an open end 15B therethrough, and threads 15A for affixation of the guide 15 to the lowermost end of the body 10, the uppermost end of the guide 15 being in contact with the lowermost end of the packer element 14.

Figure 6A:
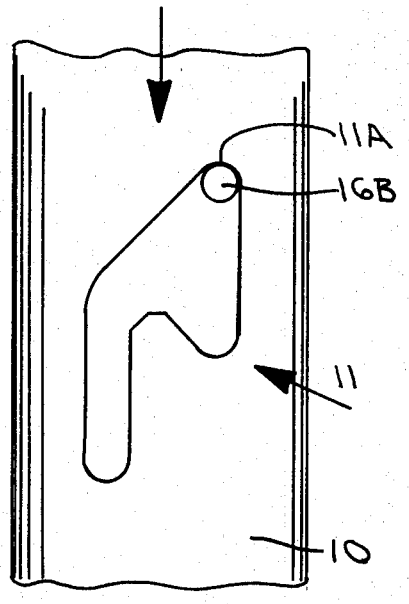
FIGS. 6A, 6B, 6C, 6D and 6E are, respectively, cross-sectional views taken along lines 6A—6A, 6B—6B, 6C—6C, 6D—6D and 6E—6E, of FIGS. 1 through 5, illustrating the positioning of the control pin relative to the J slot in the body during positioning, anchoring and setting of the packer assembly.
Figure 6B:
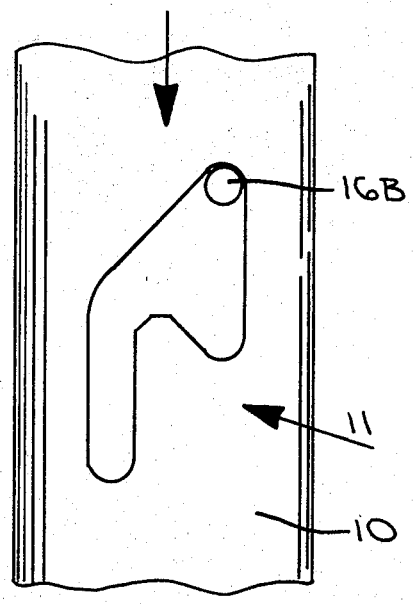
Figure 6C:
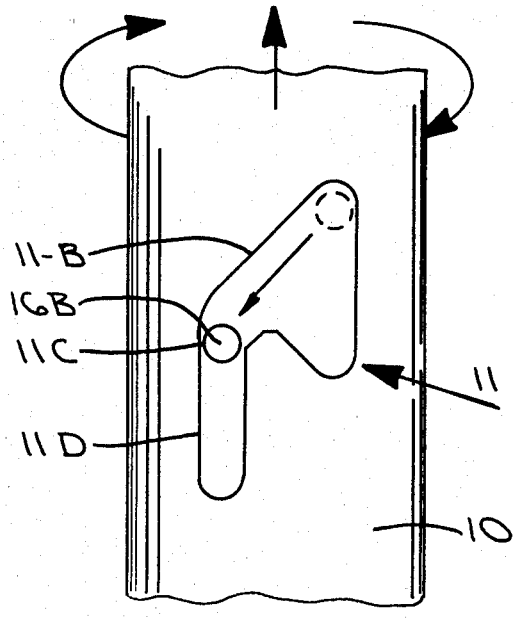
Figure 6D:
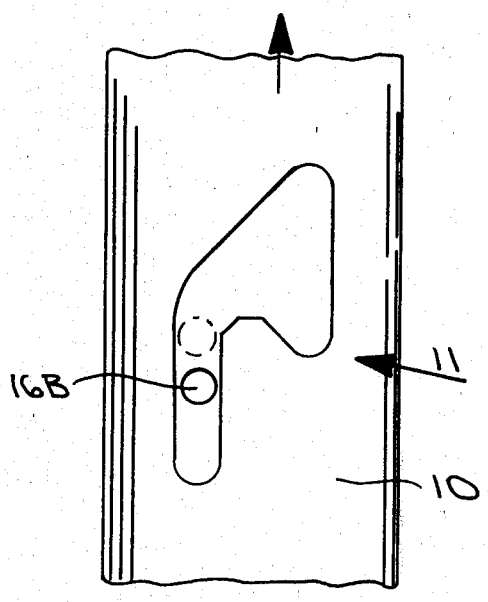
Figure 6E:
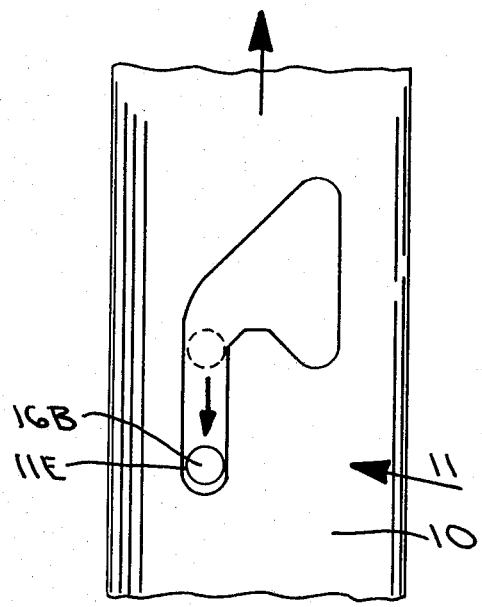

Now referring to FIGS. 6A through 6E, the slot 11 has defined on one end thereof a "running" position 11A for initial receipt of the control pin 16B. As the tubing T is rotated about its axis to the left and picked up during the anchoring and packer setting steps, the slot 11 will move relative to the collet assembly 16, such that the control pin 16B moves along the collet setting wall 11B to the collet "set" position 11C at the onset of the travel leg 11D. Finally, as shown in FIG. 6E, the slot 11 and the control pin 16B move relative to one another until the pin 16B is in the "packed off" position 11E at the foot of the travel leg 11D.

The collet assembly 16 is carried around the exterior of the body 10 and is operationally associatable therewith by means of a control pin 16B carried within the collet head 16A and protruding into the slot 11 of the body 10. The collet assembly 16 has a series of circumferentially extending, spaced elongated finger components 16C which are flexed inwardly when inserted within the casing C, but which normally are urged outwardly away from the body 10. Each finger 16C has at its lowermost end a "spoon" configuration 16D with an interior facing inner surface 16D' for selective receipt within the pocket defined on the cone 13 by the wall 13B and the shoulder 13C and an outer surface 16D'' which travels along the interior wall of the casing C as the apparatus A is run within the well W, and which is received within the coupling recess CR as the apparatus A is anchored within the well W. Each spoon 16D also has a beveled upwardly facing upper bevel 16D''' contoured to engage the upper end CR-2 of the coupling recess CR, to assist in preventing disengagement of the collet assembly 16 from the casing C. A similar lowerly facing lower bevel 16D'''' also is defined on the lowermost end of each spoon member 16D for engagement immediate the lower end CR-1 of the coupling recess CR. The lowermost face 16D''''' of each spoon 16D will contact the bevel 13A of the cone 13 as the apparatus A is manipulated into anchored position from the position shown in FIG. 3 to the position shown in FIG. 4.

Figure 4:
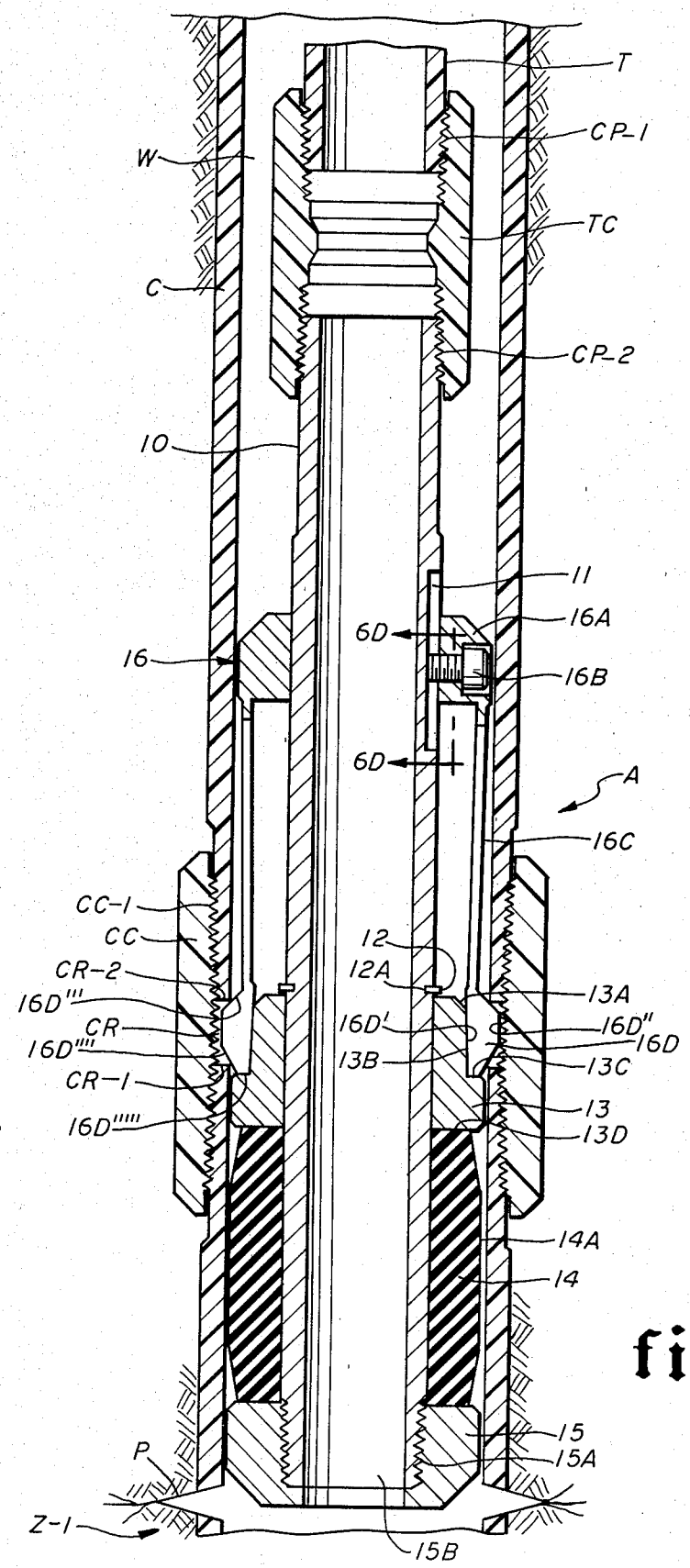
FIG. 4 is a view similar to that shown in FIG. 3, illustrating the relative positioning of the collet mechanism, the coupling recess and the packer cone, with the packer assembly in the fully anchored position.
Figure 5:
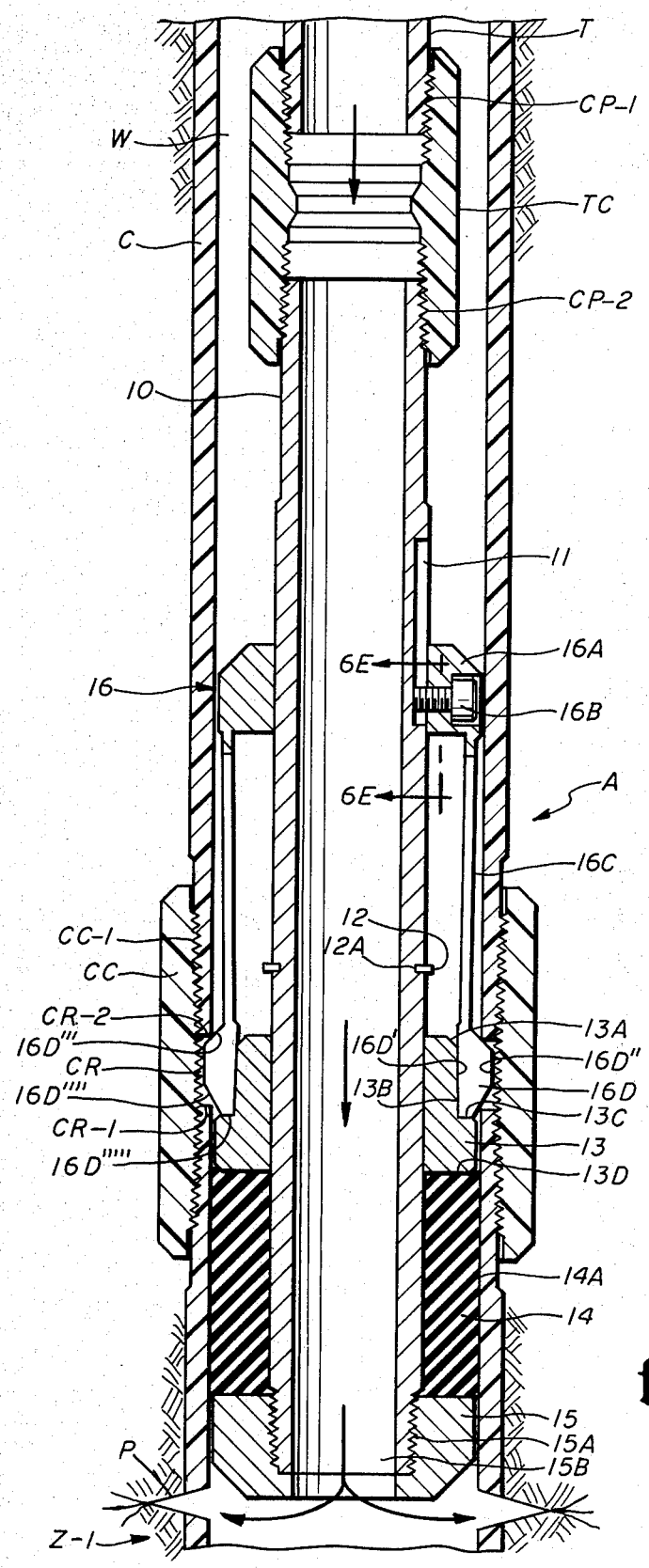
FIG. 5 is a view similar to that of FIG. 4, illustrating the packer apparatus in the completely anchored and packed off position, with corrosive injection fluid being injected through the tubular string and the packer apparatus and into the perforations within the production zone.

Although not an actual part of the apparatus A, but essential to the anchoring engagement of the apparatus A within the well bore W, is a coupling recess CR having a lower end CR-1 and an upper end CR-2, and defined by the threaded engagement of a casing coupling CC having threads CC-1 for affixation between two sections of casing C. The space defined between the threaded links of casing C define the length of the recess CR. As the apparatus A is manipulated for anchoring engagement within the well bore W, the outer surface 16D'' of each spoon 16D will become engaged within the coupling recess CR, and the apparatus A will become anchoringly engaged relative to the casing C as the cone 13 is longitudinally aligned with the inner surface 16D' of each spoon 16D, as shown in FIGS. 4 and 5.

OPERATION

Figure 2:
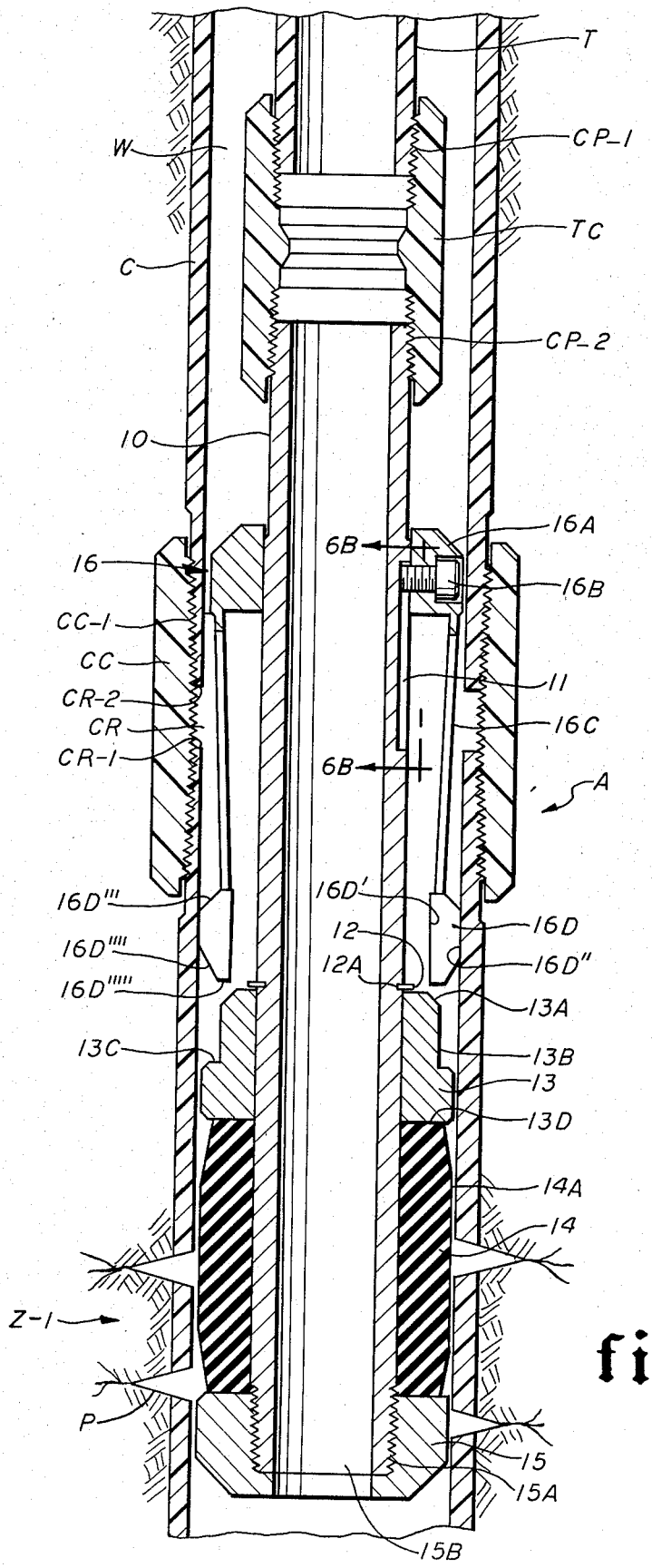
FIG. 2 is a view similar to that of FIG. 1, illustrating the position of the packer apparatus subsequent to the collet assembly initially passing below the coupling recess.
Figure 3:
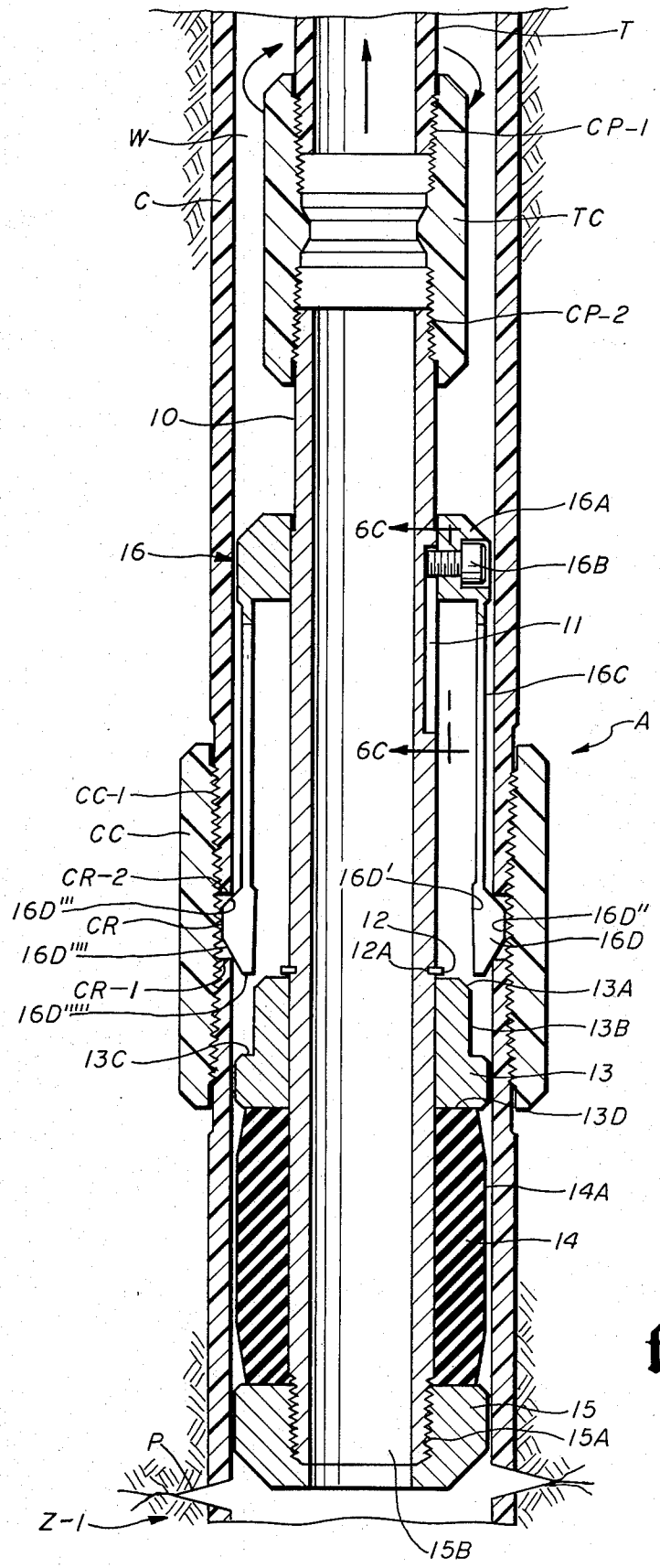
FIG. 3 is a view similar to that shown in FIGS. 1 and 2, illustrating the anchoring of the packer assembly through the collet mechanism, in a casing coupling recess, as the tubing is simultaneously picked up and rotated in one direction about its axis.

As shown in FIG. 1, the apparatus A is run in the well bore W on the tubing string T within the casing C. The control pin 16B is at the running position 11A of the slot 11, as shown in FIG. 6A. As the apparatus A approaches the depth in the well bore W of the coupling recess CR, the lower bevel 16D'''' of the outwardly urged collet assembly 16 will contact the lower end CR-1 of the coupling recess CR, and such contact, or resistance to further lower longitudinal travel of the apparatus A, will be detected at the surface of the well bore W. The tubing T then is permitted to move downwardly, slightly, kicking the lower bevel 16D'''' out of the coupling recess CR. This position is as shown in FIG. 2. The control pin 16B still remains in the running position 11A, as shown in FIG. 6B. Now, the tubing T is picked up and, simultaneously, rotated to the left and, as illustrated in FIG. 6C, the slot 11 and control pin 16B travel relative to the collet setting wall 11B until the control pin 16B is in the collet "set" position 11C in the travel leg 11D. This permits the collet assembly 16 to move upwardly relative to the casing C until the outer surface 16D'' of each spoon 16D is snugly engaged within the coupling recess CR below the upper end CR-2 and above the lower end CR-1. This position is as shown in FIG. 3. As the tubing T continues to be picked up and rotated, the upper bevel 16D''' of each spoon 16D will encounter the upper end CR-2 of the coupling recess CR, thus preventing any upward travel of the collet assembly 16 relative to the body 10. The body 10 will continue to move upwardly as the tubing T is picked up and rotated to permit the wall 13B of the cone 13 to become longitudinally aligned with the inner surface 16D' of the spoon 16D, with the lower end 16D''''' of each spoon 16D resting upon the shoulder 13C of the cone 13. Now, the spoon 16D is snugly engaged between the coupling recess CR and the cone 13, as shown in FIG. 4, the relative position of the control pin 16B and the slot 11 being illustrated at this point of operation in FIG. 6D.

To set the packer element 14 subsequent to the anchoring of the apparatus A relative to the casing C, the tubing T continues to be picked up and rotated to the left. However, since the collet assembly 16 is engaged within the coupling recess CR, thus preventing upward travel of the collet assembly 16 relative to the casing C, continued upward and rotational travel of the tubing T is transmitted through the cone 13 to the packer element 14, for compression of the packer element 14 outwardly into sealing engagement with the interior of the casing C, with the control pin 16B being positioned relative to the slot 11 in the "pack off" position 11E, as illustrated in FIG. 6E. Corrosive injection fluid, such as sulfuric acid solution, now may be injected from the top of the well through the interior of the tubing T, through the open end 15B of the apparatus A and into the perforations P of the injection zone Z-1 to carry copper, uranium or other desired material away from the well bore W to a production well (not shown).

The packer apparatus A may be removed from the well W simply by reversing the procedure, described above. As the tubing string T is lowered, the control pin 16B will automatically be repositioned at the running position 11A of the slot 11.

Although the invention has been described in terms of specified embodiments which has been set forth in detail, it should be understood that this is by illustration only and that the invention is not necessarily limited thereto, since alternative embodiments and operating techniques will become apparent to those skilled in the art in view of the disclosures. Accordingly, modifications are contemplated which can be made without departing from the spirit of the described invention.

What is claimed and desired to be secured by Letters Patent is:

1. A method of injecting a corrosive liquid into the bore of an injection well during mineral leaching operations, said well being encased by a first conduit having first and second conduit members, said conduit members being interengaged by a coupling element whereby a locking recess is defined within said coupling element and between said conduit members, comprising the steps of:

(1) introducing into said well a packer assembly carried on a second conduit, said packer assembly comprising: a body member communicating to said second conduit; an inwardly flexible, outwardly urged collet assembly exterior of said body; a slotted configuration on said body; control means on said collet assembly and carryable within said slotted configuration; means on said body defining a pocket for selective receipt of said collet assembly relative to said locking recess; and elastomeric packer body means below said pocket means and carried by said body member, contourably urged into sealing relation which said first conduit subsequent to locking engagement of said collet assembly and said second conduit;

(2) locating said collet assembly effectively below said locking recess;

(3) simultaneously rotating and picking up said second conduit to enable said collet assembly to effectively be received within said locking recess;

(4) continuing manipulation of said second conduit subsequent to step (3), above, whereby said pocket is effectively immediate said collet assembly, whereby the locked relationship between said locking recess, said collet assembly and said pocket prevents relative longitudinal movement between said packer assembly and said first conduit; and (5) continuing manipulation of said second conduit as in step (3), above, whereby said elastomeric packer body means is urged into sealing engagement with said first conduit.

2. A method of injecting a corrosive liquid into the bore of an injection well during mineral leaching operations, said well being encased by a first conduit having first and second conduit members, said conduit members being interengaged by a coupling element whereby a locking recess is defined within said coupling element and between said conduit members, comprising the steps of:

(1) introducing into said well a packer assembly carried on a second conduit, said packer assembly comprising: a body member communicating to said second conduit; an inwardly flexible, outwardly urged collet assembly exterior of said body; a slotted configuration on said body; control means on said collet assembly and carryable within said slotted configuration; means on said body defining a pocket for selective receipt of said collet assembly relative to said locking recess; and elastomeric packer body means below said pocket means and carried by said body member, contourably urged into sealing relation with said first conduit subsequent to locking engagement of said collet assembly and said second conduit;

(2) locating said collet assembly effectively below said locking recess;

(3) simultaneously rotating and picking up said second conduit to enable said collet assembly to effectively be received within said locking recess;

(4) continuing manipulation of said second conduit subsequent to step (3), above, whereby said pocket is effectively immediate said collet assembly, whereby the locked relationship between said locking recess, said collet assembly and said pocket prevents relative longitudinal movement between said packer assembly and said first conduit;

(5) continuing manipulation of said second conduit as in step (3), above, whereby said elastomeric packer body means is urged into sealing engagement with said first conduit; and (6) injecting a corrosive carrier fluid through said second conduit and said packer assembly into said well and toward at least one production well.

3. A method of producing a subterranean well through which is transmitted a corrosive liquid during mineral leaching operations, said well being encased by a first conduit having first and second conduit members, said conduit members being interengaged by a coupling element whereby a locking recess is defined within said coupling element and between said conduit members, comprising the steps of:

(1) introducing into said well a packer assembly carried on a second conduit, said packer assembly comprising: a body member communicating to said second conduit; an inwardly flexible, outwardly urged collet assembly exterior of said body; a slotted configuration on said body; control means on said collet assembly and carryable within said slotted configuration; means on said body defining a pocket for selective receipt of said collet assembly relative to said locking recess; and elastomeric packer body means below said pocket means and carried by said body member, contourably urged into sealing relation with said first conduit subsequent to locking engagement of said collet assembly and said second conduit;

(2) locating said collet assembly effectively below said locking recess;

(3) simultaneously rotating and picking up said second conduit to enable said collet assembly to effectively be received within said locking recess;

(4) continuing manipulation of said second conduit subsequent to step (3), above, whereby said pocket is effectively immediate said collet assembly, whereby the locked relationship between said locking recess, said collet assembly and said pocket prevents relative longitudinal movement between said packer assembly and said first conduit; and (5) continuing manipulation of said second conduit as in step (3), above, whereby said elastomeric packer body means is urged into sealing engagement with said first conduit.

4. A method of producing a subterranean well through which is transmitted a corrosive liquid during mineral leaching operations, said well being encased by a first conduit having first and second coupling element whereby a locking recess is defined within said coupling element and between said conduit members, comprising the steps of;

(1) introducing into said well a packer assembly carried on a second conduit, said packer assembly comprising: a body member communicating to said second conduit; an inwardly flexible, outwardly urged collet assembly exterior of said body; a slotted configuration on said body; control means on said collet assembly and carryable within said slotted configuration; means on said body defining a pocket for selective receipt of said collet assembly relative to said locking recess; and elastomeric packer body means below said pocket means and carried by said body member, contourably urged into sealing relation with said first conduit subsequent to locking engagement of said collet assembly and said second conduit;

(2) locating said collet assembly effectively below said locking recess;

(3) simultaneously rotating and picking up said second conduit to enable said collet assembly to effectively be received within said locking recess;

(4) continuing manipulation of said second conduit subsequent to step (3), above, whereby said pocket is effectively immediate said collet assembly, whereby the locked relationship between said locking recess, said collet assembly and said pocket prevents relative longitudinal movement between said packer assembly and said first conduit;

(5) continuing manipulation of said second conduit as in step (3), above, whereby said elastomeric packer body means is urged into sealing engagement with said first conduit; and (6) producing through said well the liquid product of said mineral leaching operation.

5. A method of producing a subterranean well through which is transmitted a corrosive liquid during fluid production operations, said well being encased by a first conduit having first and second coupling element whereby a locking recess is defined within said coupling element and between said conduit members, comprising the steps of:

(1) introducing into said well a packer assembly carried on a second conduit, said packer assembly comprising: a body member communicating to said second conduit; an inwardly flexible, outwardly urged collet assembly exterior of said body; a slotted configuration on said body; control means on said collet assembly and carryable within said slotted configuration; means on said body defining a pocket for selective receipt of said collet assembly relative to said locking recess; and elastomeric packer body means below said pocket means and carried by said body member, contourably urged into sealing relation with said first conduit subsequent to locking engagement of said collet assembly and said second conduit;

(2) locating said collet assembly effectively below said locking recess;

(3) simultaneously rotating and picking up said second conduit to enable said collet assembly to effectively be received within said locking recess;

(4) continuing manipulation of said second conduit subsequent to step (3), above, whereby said pocket is effectively immediate said collet assembly, whereby the locked relationship between said locking recess, said collet assembly and said pocket prevents relative longitudinal movement between said packer assembly and said first conduit;

(5) continuing manipulation of said second conduit as in step (3), above, whereby said elastomeric packer body means is urged into sealing engagement with said first conduit; and (6) producing through said well the liquid product of said fluid production operations.

* * * * *